United States Patent [19]

Kumazawa et al.

[11] Patent Number: 4,666,398

[45] Date of Patent: May 19, 1987

[54] SPACE HEATER

[75] Inventors: Katsuyoshi Kumazawa, Yamato; Minoru Komori, Ebina, both of Japan

[73] Assignee: Kabushiki Kaisha Toshiba, Kawasaki, Japan

[21] Appl. No.: 906,087

[22] Filed: Sep. 11, 1986

[30] Foreign Application Priority Data

Sep. 13, 1985 [JP] Japan ..... 60-202670

[51] Int. Cl.[4] ..... F23D 5/00

[52] U.S. Cl. ..... 431/201; 431/200; 431/198; 431/344; 431/304; 431/309; 431/312; 431/325; 126/96

[58] Field of Search ..... 431/198, 200, 201, 344, 431/312, 313, 325, 315, 309, 304, 305, 306, 307, 308; 126/96, 97, 95

[56] References Cited

U.S. PATENT DOCUMENTS 1,458,774 6/1923 Meyers ..... 431/201

2,800,174 7/1957 Konstadt ..... 431/325 X 4,484,886 11/1984 Nakamura et al. ..... 431/201

FOREIGN PATENT DOCUMENTS 586309 7/1981 Japan .

*Primary Examiner*—Randall L. Green

*Attorney, Agent, or Firm*—Cushman, Darby & Cushman

[57] ABSTRACT

Large numbers of vent holes are respectively formed in inner and outer flame cylinders defining an annular combustion chamber to supply air thereto. A total opening area of the vent holes formed in the outer flame cylinder is greater than that of the vent holes formed in the inner flame cylinder. As a result, the heat capacity of the outer flame cylinder is smaller than that of the inner flame cylinder. During combustion, the outer flame cylinder is heated to red-hot. A plurality of projections are formed on the outer wall surface of the inner flame cylinder to allow complete combustion of a fuel vapor.

6 Claims, 7 Drawing Figures

SPACE HEATER

BACKGROUND OF THE INVENTION

The present invention relates to a wick type space heater mainly used for indoor heating and, more particularly, to a space heater capable of completely combusting fuel in a combustion chamber.

Wick type space heaters have prevailed as indoor heating equipment.

The main part of a conventional wick type space heater, e.g., a typical plural cylinder type heater in a kerosene stove has the following construction. The main part comprises a fuel tank, inner and outer flame cylinders concentrically arranged above the fuel tank so as to constitute a combustion chamber therebetween, a narrow annular path for causing the combustion chamber to communicate with the fuel tank, and a cylindrical wick, the lower end portion of which is dipped in kerosene in the fuel tank and the upper end portion of which is inserted in the combustion chamber through the narrow path to soak up kerosene by capillary action. A plurality of vent holes are formed in the inner and outer cylinders to supply air to the combustion chamber. The kerosene vapor evaporated from the upper end of the wick is combusted in the combustion chamber. In addition, by adjusting an exposed portion of the wick in the combustion chamber, the heating power is adjusted.

In such a kerosene stove, the upper end portion of the wick exposed in the combustion chamber is fired by an ignition unit, and air required for combustion is supplied from the plurality of vent holes formed in the inner and outer flame cylinders, thereby accelerating combustion. Heat generated by this combustion heats the exposed upper end portion of the wick in the combustion chamber to increase the evaporation amount of the kerosene. For this reason, the combustion area is gradually increased. When the heat radiated from the upper end portion of the wick is balanced with the heat supplied to the upper end portion thereof, a steady combustion state is achieved.

In such a plural cylinder wick type kerosene stove, however, the following problem is presented. In general, an outer flame cylinder is heated to red-hot, and heat radiated therefrom is used for indoor heating. In order to heat the outer flame cylinder to red-hot, the number of vent holes formed in the outer flame cylinder is about 7 to 10 times that in the inner flame cylinder. The total opening area of the vent holes of the outer flame cylinder is larger than that of the inner flame cylinder to decrease the heat capacity of the outer flame cylinder, thereby heating it to red-hot. During the use of the kerosene stove, the inner flame cylinder is kept at a temperature lower than that of the outer flame cylinder. Since the total opening area of the vent holes of the outer flame cylinder is greatly larger than that of the inner flame cylinder, the amount of air supplied from the vent holes of the outer flame cylinder to the combustion chamber is greater than that of the inner flame cylinder. The fuel vapor evaporated from the upper end portion of the wick flows toward the outer wall surface of the inner flame cylinder due to the influence of air flowing from the outer flame cylinder. The fuel vapor then flows upward in the combustion chamber in the form of a vapor layer. Since the inner flame cylinder is kept at a lower temperature, as described above, part of the fuel vapor rising along the outer surface of the inner flame cylinder is exhausted as a noncombusted fuel vapor, thus generating toxic gases such as CO and THC.

SUMMARY OF THE INVENTION

It is an object of the present invention to provide a space heater which employs a system for heating an outer flame cylinder to red-hot, which can completely combust a fuel vapor supplied to a combustion chamber, and which does not substantially generate toxic gases.

According to the present invention, there is provided a space heater with a plurality of projections on the outer surface of the inner flame cylinder.

As described above, since the amount of air flowing from the vent holes of the inner flame cylinder is far smaller than that from the vent holes of the outer flame cylinder, the fuel vapor evaporated from the upper end portion of the wick tends to rise along the outer surface of the inner flame cylinder. However, the plurality of projections are formed on the outer surface of the inner flame cylinder, and the flow direction of the fuel vapor is forcibly changed to a direction to separate from the outer surface of the inner cylinder or the like or to form a vortex. In this manner, the fuel vapor flows in the form of a vortex, the fuel vapor stays in the combustion chamber for a long period of time. As a result, the fuel vapor is mixed well with air to automatically achieve a state for allowing complete combustion. As a result, the entire fuel can be completely combusted, and hence generation of toxic gases can be properly controlled. The projections formed on the outer surface of the inner flame cylinder also serve to disperse the fuel vapor and air, or a gas mixture of the fuel vapor and air along the circumferential direction. Even if a so-called cross pin horizontally extends through the combustion chamber to mechanically couple the inner and outer flame cylinders, a flame does not go out in the downstream of the cross pin, which tends to occur in a conventional construction. Fuel can be uniformly evaporated from the upper end portion of the wick, thereby achieving stable combustion in the inner peripheral space of the combustion chamber.

DETAILED DESCRIPTION OF THE PREFERRED EMBODIMENTS

Figure 1:
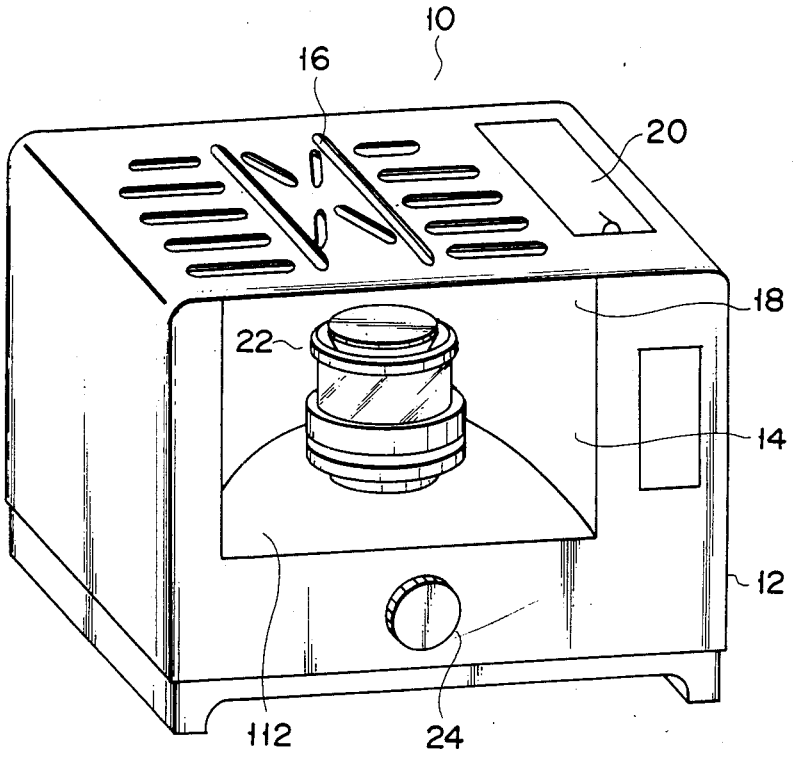
FIG. 1 is a perspective view of a wick type kerosene stove according to an embodiment of the present invention.

FIG. 1 shows wick type kerosene stove 10 which adopts the present invention. Single large opening 14 is formed at the front surface portion of housing 12 of stove 10. A plurality of slit openings 16 are formed at the upper surface portion of housing 12. Heat reflector 18 is arranged in housing 12 to oppose opening 14. Cartridge type kerosene tank 20 is detachably mounted outside heat reflector 18 in housing 12. Burner 22 is disposed in front of reflector 18. Knob 24 is mounted on the front wall portion of the housing 12 and is located immediately under opening 14.

Figure 2:
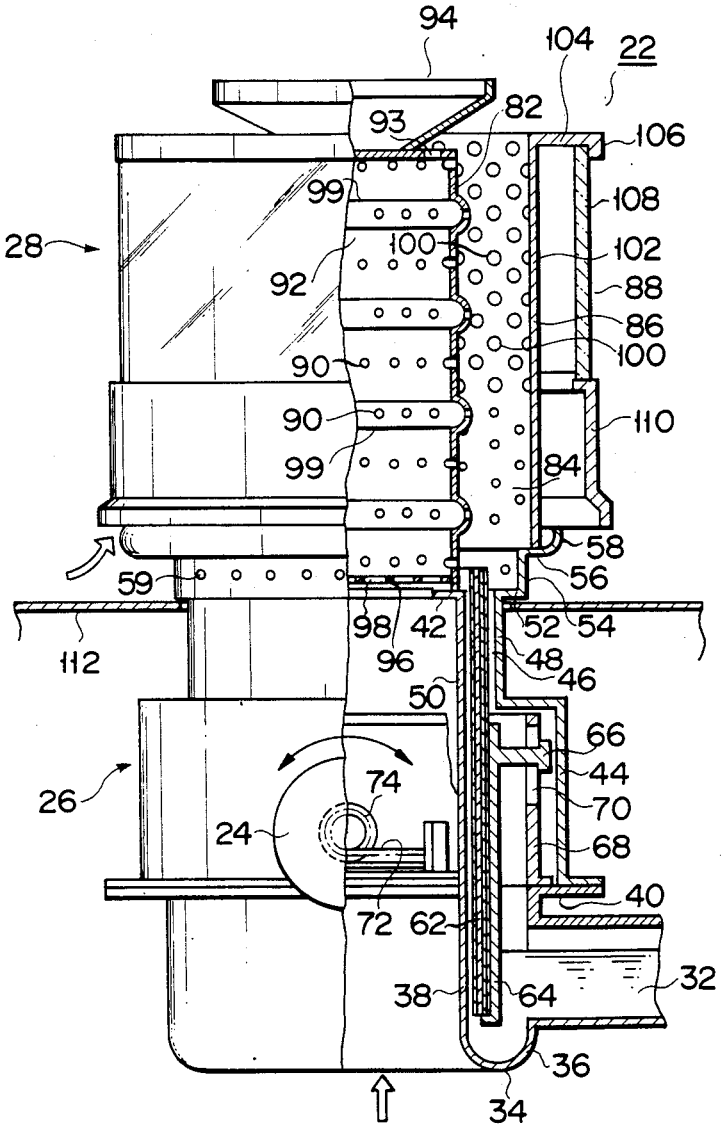
FIG. 2 is a partially cutaway side view of a burner incorporated in the kerosene stove.
Figure 3:
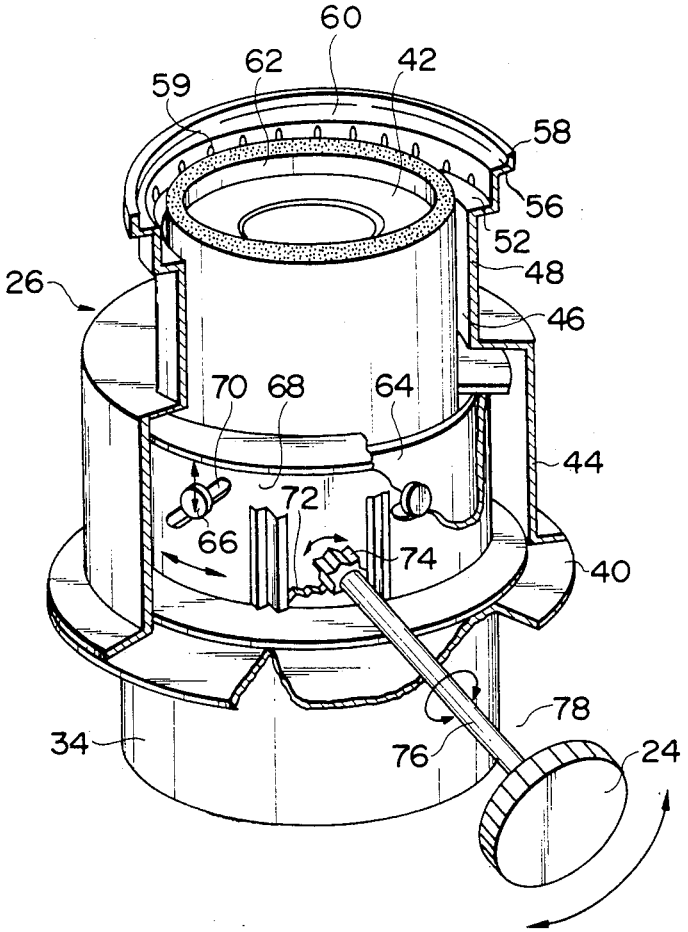
FIG. 3 is a partially cutaway perspective view showing a fuel supply portion of the burner in FIG. 2.

Burner 22 is constructed as shown in FIGS. 2 and 3. Burner 22 comprises fuel supply portion 26 and combustion portion 28.

Fuel supply portion 26 is disposed such that the opening faces upward, and comprises annular fuel tank 34 to be replenished with kerosene 32 from tank 20 up to a predetermined level. Tank 34 is made of a metal. Inner wall 38 of fuel tank 34 is significantly longer than its outer wall 36 along the axial direction. Collar 40 is formed at the upper end of outer wall 36 and is bent outward. Collared grate 42 is formed at the upper end of inner wall 38. Stepped metal cylinder 44 is coaxial with outer wall 36 and is liquid-tightly fixed on the upper surface of collar 40 formed at the upper end of outer wall 36. The lower portion of cylinder 44 has a larger diameter than that of outer wall 36 of fuel tank 34, and the upper portion of cylinder 44 has a smaller diameter than that of the outer wall 36. The upper portion of cylinder 44 and the upper portion of inner wall 38 constitute wick guide cylinders 48 and 50 for guiding wick 62 to be described later. First to fourth portions 52 to 58 are integrally formed with the upper end portion of cylinder 48, as shown in FIG. 3. First portion 52 has the same level as that of grate 42 and extends slightly outward. Second portion 54 is integrally formed with the distal end of portion 52 and extends upward for a predetermined length. Third portion 56 is integrally formed with the distal end of portion 54 and extends horizontally for a predetermined length. Fourth portion 58 is integrally formed with portion 56 and extends upward. Portions 56 and 58 constitute grate 60 for supporting outer flame cylinder 86 to be described later. A plurality of vent holes 59 are formed in second portion 54.

Wick 62 of glass fiber or the like is inserted in narrow annular path 46 defined by cylinders 48 and 50 to soak up kerosene by capillary action. The lower end portion of wick 62 is dipped in kerosene in tank 34. Wick 62 has a thickness sufficient to cause the inner and outer surfaces of the wick to be brought into sliding contact with the corresponding surfaces of cylinders 48 and 50. Wick 62 is supported by support cylinder 64 disposed in a portion surrounded by tank 34 and cylinder 44. Cylinder 64 is vertically movable but not rotatable. Pins 66 extend outward from the outer surface of support cylinder 64 and are fitted in inclined holes 70 formed in cylinder 68 rotatably supported by collar 40. Rack 72 is fixed on the outer surface of cylinder 68, as shown in FIG. 3. Rack 72 meshes with pinion 74. Pinion 74 is coupled to shaft 76 liquid-tightly extending through cylinder 44. Shaft 76 is coupled to knob 24. Knob 24, shaft 76, pinion 74, rack 72, cylinder 68, holes 70, pins 66, and cylinder 64 constitute wick position control mechanism 78.

Combustion portion 28 is constructed in the following manner. As shown in FIG. 2, combustion portion 28 comprises inner flame cylinder 82 placed on grate 42 formed at the upper end of cylinder 50, outer flame cylinder 86 defining combustion chamber 84 together with inner flame cylinder 82 placed on portion 56 constituting grate 60, and outer cylinder 88 surrounding outer flame cylinder 86.

Cylinder 82 comprises: cylindrical body 92 disposed such that the opening thereof faces downward and having vent holes 90 formed in the circumferential surface; holes 93 formed in the upper surface of cylindrical body 92; funnel-shaped air flow deflector 94 for deflecting the air flow through the inner space of cylinder 92 and holes 93 so as to perform final combustion; and disk-like air flow limiting plate 98 fixed inside cylindrical body 92 and having a plurality of vent holes 96. Four annular projections 99 are formed on the outer wall surface of cylindrical body 92 by pressing and are parallel to each other along the axial direction. Outer flame cylinder 86 comprises: cylindrical body 102 having open ends and a plurality of vent holes 100 on its circumferential surface; collar 104 integrally formed with the upper end portion of cylindrical body 102 and extending outward; and projected circumferential wall 106 extending slightly downward from the edge of collar 104. Holes 90 and 100 formed in the upper portions of cylindrical bodies 92 and 102 have larger diameters than those in the lower portions thereof, respectively. With this arrangement, the amount of air supplied to the upper space in chamber 84 is larger than that supplied to the lower space thereof. The number of vent holes 100 in cylindrical body 102 is about 10 times that of vent holes 90 in cylindrical body 92. In other words, the total opening area of vent holes 100 in cylindrical body 102 is sufficiently larger than that of vent holes 90 in cylindrical body 92. Cylinder 88 comprises transparent glass cylinder 108 and metal cylinder 110 which are coaxial and vertically coupled. The upper end of cylinder 108 is fixed on wall 106. Cylinders 82 and 86 are coupled by a cross pin (not shown). Fuel supply portion 26 and combustion portion 28 constructed as described above are mounted on partition plate 112 through a hole in such a manner that a portion located above the upper end of portion 26 is externally exposed.

The operation of the kerosene stove having the construction described above will be described hereinafter.

Knob 24 is rotated to move the upper end portion of wick 62 upward above grate 42. When knob 24 is further rotated, pinion 74 is rotated to move rack 72 in the circumferential direction. As a result, cylinder 68 is rotated. Cylinder 64 cannot be rotated since it is coupled through pins 66 inserted in holes 70 formed in cylinder 68, but cylinder 64 is vertically movable. When cylinder 68 is rotated, a vertical force acts on cylinder 64 through pins 66. In this manner, when knob 24 is rotated, the upper end portion of wick 62 is exposed inside combustion chamber 84. In this case, part of kerosene 32 stored in tank 34 is soaked up through wick 62 by capillary action and reaches the upper end portion of wick 62.

In this state, the upper end portion of wick 62 is lit by an ignition unit (not shown). At the beginning of ignition, wick 62 is kept at a low temperature. For this reason, the flame formed at the upper end portion of wick 62 is small and the heating power is minimal. When the upper end portion of wick 62 is then lit, air required for combustion flows in combustion chamber 84 through vent holes 90 and 100 respectively formed in cylindrical bodies 92 and 102 by natural convection. When a predetermined period of time has elapsed, the temperature of the upper end portion of wick 62 is increased since it receives heat from the combustion region. For this reason, the evaporation amount of kerosene from the upper end portion of wick 62 is increased, and the heating power is also increased. When the heating power is increased, outer flame cylindrical body 102 having a smaller heat capacity than that of cylindrical body 92 is heated to red-hot. A steady combustion state is then obtained when the heat radiated from the upper end portion of wick 62 is balanced with the heat supplied to the upper end portion thereof. The combustion strength, i.e., the heating power in the steady combustion state can be freely adjusted by turning knob 24.

Figure 4:
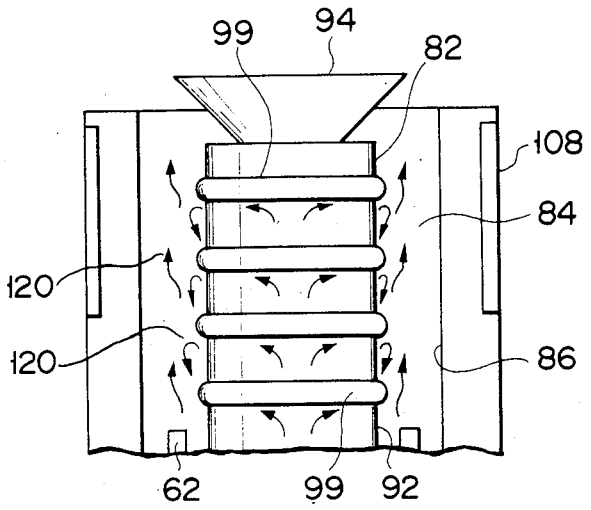
FIG. 4 is a schematic view for explaining a phenomenon occurring in the combustion chamber in the burner in FIG. 2.

Since the number of vent holes 100 formed in cylindrical body 102 is larger than that of vent holes 90 formed in cylindrical body 92, the amount of air supplied through vent holes 100 is greater than that through vent holes 90. For this reason, fuel gas evaporated from the upper end portion of wick 62 flows toward the outer wall surface of inner flame cylinder 92 and tends to rise along the outer wall surface of cylindrical body 92 kept at a temperature lower than that of cylindrical body 102. However, projections 99 are formed on the outer wall surface of cylindrical body 92 and the fuel gas is disturbed by projections 99. As indicated by solid arrows 120 in FIG. 4, the flow direction of the fuel gas is changed toward the central and circumferential directions of combustion chamber 84 or the linear fuel gas flow is converted into vortices. Therefore, the fuel gas stays in combustion chamber 84 for a long period of time and is sufficiently mixed with air. In this manner, the fuel gas is sufficiently mixed with air to allow complete combustion. The entire fuel gas can be completely combusted within combustion chamber 84. The fuel gas is also dispersed in the circumferential direction because of the presence of projections 99. The gas mixture can sufficiently reach the downstream side of the cross pin for coupling inner flame cylinder 82 and outer flame cylinder 86. The flame does not go out for this reason. In addition, the fuel gas can be uniformly combusted along the circumferential direction of combustion chamber 84.

Figure 5:
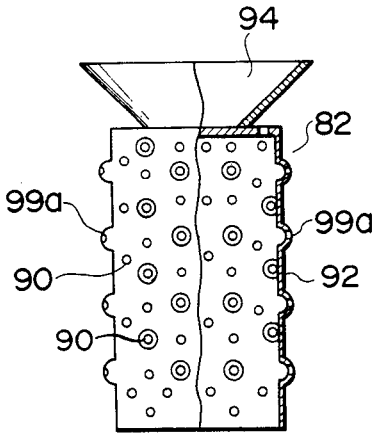
FIGS. 5 and 6 are partially cutaway side views showing modifications of the inner flame cylinder, respectively.
Figure 6:
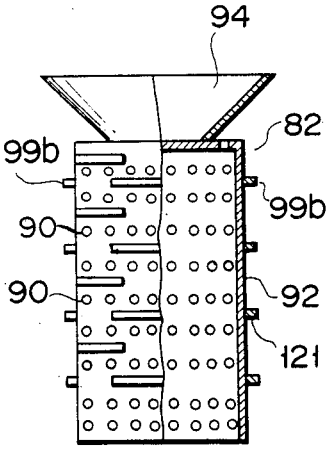

The present invention is not limited to the particular embodiment described above. In the above embodiment, inner flame cylinder body 92 is obtained by pressing to form a plurality of annular projections 99 along the axial direction thereof. However, a plurality of circular projections **99*a* may be formed by pressing, as shown in FIG. 5. Alternatively, as shown in FIG. 6, a plurality of members 121 constituting projections 99*b* on the outer wall surface of inner flame cylindrical body 92** may be welded.

Figure 7:
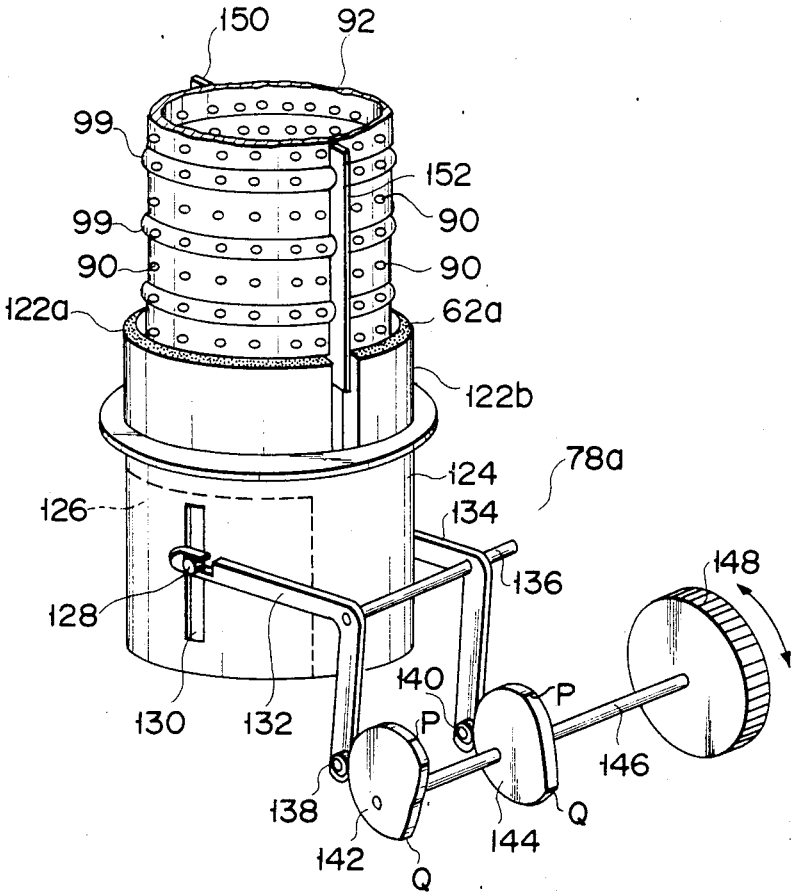
FIG. 7 is a perspective view showing the main part of a wick type kerosene stove according to another embodiment of the present invention.

The present invention is applicable to a kerosene stove wherein a wick is split into halves, and one half of the wick is used within a specific heating power adjustment range. FIG. 7 shows the main part of a kerosene stove of this type. In this kerosene stove, wick halves **122*a* and 122*b* constitute wick 62*a*. Wick half 122*b* is supported by support cylinder 124, and wick half 122*a* is supported by support member 126 which is vertically movable independently of support cylinder 124 within support cylinder 124. Cylinder 124 and member 126 are controlled by wick position control mechanism 78*a*. Control mechanism 78*a* is constructed as follows. Pin 128 extends from the outer wall surface of support member 126 and appears outside through vertical slit 130 in support cylinder 124. A pin (not shown) extends on the outer wall surface of support cylinder 124. Each of pin 128 and the pin extending on support cylinder 124 is loosely coupled to one end of a corresponding one of L-shaped bars 132 and 134. Bent portions of bars 132 and 134 are pivotally supported by shaft 136. Each of small-diameter rollers 138 and 140 is coupled to the other end of the corresponding one of bars 132 and 134. Rollers 138 and 140 are in contact with the circumferential surfaces of eccentric cams 142 and 144, respectively. Cams 142 and 144 are commonly fixed on shaft 146. Circumferential portions from point P to point Q (counterclockwise) of cams 142 and 144 have an identical shape, but circumferential portions from point P to point Q (clockwise) of cams 142 and 144 have different shapes. More specifically, the radius of curvature of cam 144 from point P to point Q (clockwise) is larger than that thereof from point P to point Q (counterclockwise). The circumferential portion of cam 142 from point P to point Q (clockwise) is greatly recessed with respect to the circumferential portion of cam 144 from point P to point Q (clockwise) toward the shaft 146. Shaft 146 is coupled to knob 148. Inner flame cylindrical body 92 has projections 99 on its outer surface in the same manner as in FIG. 2. However, cylindrical body 92 has partition walls 150 and 152 for partitioning the combustion chamber defined by the outer wall surface of cylindrical body 92 into a region receiving wick half 122*a* and a region receiving wick half 122*b***.

With the above construction, when rollers 138 and 140 are respectively in contact with the circumferential portions of cams 142 and 144 from points P to points Q (counterclockwise), wick halves **122*a* and 122*b* are vertically moved with an identical level. However, when rollers 138 and 140 are in contact with the circumferential portions of rollers 138 and 140 from points P to points Q (clockwise), wick half 122*a* is kept at the lowest position, i.e., extinction position. In this case, only wick half 122*b* can be vertically moved upon rotation of knob 148**. Therefore, the heating power is reduced into half. Within the ½ heating range, finer heating power adjustment can be performed.

In the kerosene stove of this type, when only wick half **122*b* is used for combustion, the combustion area tends to be shifted toward the central portion of the region partitioned by partition walls 150 and 152. As a result, incomplete combustion tends to occur. However, when projections 99 are formed on the outer wall surface of cylindrical body 92, combustion occurs throughout the area partitioned by partition walls 150 and 152**, and complete combustion can be achieved for the reason as previously mentioned.

The present invention is not limited to kerosene stoves but is applicable to space heaters using alcohol as fuel.

What is claimed is:

1. A space heater comprising:

a fuel tank for storing liquid fuel;

an inner flame cylinder having a plurality of vent holes and disposed above said fuel tank and having a vertical axis;

a plurality of projections formed on an outer wall surface of said inner flame cylinder;

an outer flame cylinder concentrically surrounding said inner flame cylinder and adapted to cooperate with said inner flame cylinder to constitute an annular combustion chamber therebetween;

a plurality of vent holes formed in said outer flame cylinder such that a total opening area thereof is greater than that of said vent holes of said inner flame cylinder;

a narrow annular path for causing said combustion chamber to communicate with said fuel tank;

a cylindrical wick, a lower end portion of which is dipped in said liquid fuel in said fuel tank and an upper end portion of which is inserted in said combustion chamber through said narrow annular path, said wick being adapted to soak and evaporate said liquid fuel by capillary action; and means for changing a position of said wick.

2. A heater according to claim 1, wherein said projections are formed on said outer wall surface of said inner flame cylinder by pressing.

3. A heater according to claim 2, wherein said projections comprise annular projections formed on said outer wall surface of said inner flame cylinder.

4. A heater according to claim 2, wherein said projections are constituted by projected portions formed to have a uniform distribution on said outer wall surface of said inner flame cylinder.

5. A heater according to claim 1, wherein said projections are constituted by members fixed by welding on said outer wall surface of said inner flame cylinder.

6. A heater according to claim 1, wherein said wick comprises wick halves split along a circumferential direction thereof, and said means for changing the position of said wick includes a mechanism for changing a position of one of said wick halves within a specific heating power range.

* * * * *